US005569870A

United States Patent [19]

Hirano

[11] Patent Number: 5,569,870

[45] Date of Patent: Oct. 29, 1996

[54] KEYBOARD ELECTRONIC MUSICAL INSTRUMENT HAVING PARTIAL PEDAL EFFECT CIRCUITRY

[75] Inventor: Sayoko Hirano, Shizuoka-ken, Japan

[73] Assignee: Kabushiki Kaisha Kawai Gakki Seisakusho, Japan

[21] Appl. No.: 302,546

[22] Filed: Sep. 8, 1994

[30] Foreign Application Priority Data

Sep. 14, 1993 [JP] Japan ..... 5-250913

[51] Int. Cl.[6] ..... G10H 1/057; G10H 1/06; G10H 1/18

[52] U.S. Cl. ..... 84/615; 84/622; 84/627

[58] Field of Search ..... 84/615–620, 622–633

[56] References Cited

U.S. PATENT DOCUMENTS 4,909,121 3/1990 Usa et al. ..... 84/627 X 5,136,916 8/1992 Shibukawa ..... 84/627

5,403,968 4/1995 Sato ..... 84/627 X 5,434,348 7/1995 Matsuda et al. ..... 84/627 X

*Primary Examiner*—Stanley J. Witkowski

*Attorney, Agent, or Firm*—Andrus, Sceales, Starke & Sawall

[57] ABSTRACT

An electronic musical instrument has pedals, such as a damper pedal and a sostenuto pedal, and controls a read out musical tone in consonance with the position of a depressed pedal, thereby to provide the same effects as those provided by half pedal playing with an acoustic piano. The electronic musical instrument includes: a detector for detecting the position of a pedal; a memory for storing tone data that is selectable in consonance with the pedal position; a reading circuit for selecting and reading the tone data from the memory in consonance with the pedal position detected by the detector; and a tone generator for generating a musical tone by employing the tone data that are read by the reading circuit.

8 Claims, 8 Drawing Sheets

| | BUFFER (B) | | WORK (W) | |
|---|---|---|---|---|
| 0 ch | LV 0 | SP 0 | LV 0 | SP 0 |
| 1 | LV 1 | SP 1 | LV 1 | SP 1 |
| 2 | LV 2 | SP 2 | LV 2 | SP 2 |
| . | . | . | . | . |
| . | . | . | . | . |
| . | . | . | . | . |
| N−2 | LV N−2 | SP N−2 | LV N−2 | SP N−2 |
| N−1 | LV N−1 | SP N−2 | LV N−1 | SP N−1 |

Fig. 5

| |
|---|
| Σe DATA 0 ch |
| Σe DATA 1 ch |
| . |
| . |
| Σe DATA N−1 ch |

Fig. 6

(a) PEDAL OFF (b) PEDAL ON (a) HALF PEDAL (b) EXAMPLE OF RELATIONSHIP BETWEEN AN ENVELOPE AND A PEDAL POSITION

KEYBOARD ELECTRONIC MUSICAL INSTRUMENT HAVING PARTIAL PEDAL EFFECT CIRCUITRY

BACKGROUND OF THE INVENTION

1. Field of the Invention

The present invention relates to an electronic musical instrument that, in consonance with a pedal depression state, changes a tone generation state and an acoustic state following the generation of a tone.

Description of the Related Art

In the playing of pianos that are neither electrically powered nor electronically controlled (instruments that will hereafter be referred to as acoustic pianos) half pedal playing, which involves the depression of a damper pedal, is widely employed for delicate control during the tone generation state and the acoustic state that follows the generation of a tone. The feeling of a produced sound is altered mainly by changing the set position of a depressed damper pedal.

However, if the same pedal effects as those obtained with an acoustic piano are required for a conventional electronic piano, the structure of the instrument will be very complicated and it will also be difficult to reduce the manufacturing costs for the instrument. Therefore, as one means for reproducing the pedal effects of an acoustic piano, a method by which a timbre and an envelope form are changed by sensing the ON/OFF state of a pedal has been used.

Therefore, as it is not possible to provide a delicate performance with a conventional electronic piano that ensures the same effects as does half pedal playing with an acoustic piano, further improvements to the instrument have been demanded.

SUMMARY OF THE INVENTION

To overcome such a shortcoming, it is an object of the present invention to provide an electronic musical instrument that has pedals, such as a damper pedal and a sostenute pedal, and that controls a read-out musical tone, in consonance with the position of a depressed pedal, so that it can provide the same effects as those provided by half pedal playing with an acoustic piano.

An electronic musical instrument according to the present invention comprises: detecting means for detecting the position of a pedal; storage means for storing tone data that are selectable in consonance with the pedal position; reading means for selecting and reading the tone data from the storage means in consonance with the pedal position detected by the detecting means; and tone generating means for generating a musical tone by employing the tone data that are read by the reading means.

To achieve the object, the tone data that are read by the reading means from the storage means are data for the decay of the tone following release of a key of a keyboard of the instrument.

Also, to achieve the object, the tone data that are read by the reading means from the storage means are attack speed data.

Further, to achieve the object, the tone data that are read by the reading means from the storage means are tone generation level data.

In addition, to achieve the object, the tone data that are read by the reading means from the storage means are timbre data.

In an envelope data memory that constitutes the storage means, envelopes are stored separately for the pedal OFF and the pedal ON positions and for other, intermediate pedal positions, even for an identical depressed key.

The generating means generates an envelope signal by employing a "target value level LV," a parameter that designates a target value (level) for a musical tone, and an "envelope speed parameter SP," a parameter that designates a time that will elapse before a musical tone reaches its target value.

Each envelope is stored in a parameter memory of an envelope setting section, which constitutes the generating means, after it has been divided into three portions: an attack portion, a decay portion, and a release portion. Stored with each portion are parameters that consist of the "target value level LV" and the "envelope speed parameter SP."

In accordance with the above described invention, with an electronic musical instrument that has a pedal, such as a damper pedal or a sostenute pedal, which when depressed effects a change in a tone generation state and in an acoustic state following the generation of a tone, and thus provides the same effect as that obtained by half pedal playing with an acoustic piano, as long as a pedal continues to be depressed following the release of a keyboard key, the production of a read-out musical tone is controlled in consonance with the depressed state of the pedal.

In this invention, therefore, a pedal position detecting means is provided that determines the distance that a pedal is depressed. Pedal data that represent the position of the pedal as determined by the detecting means are employed to change a decay speed of an envelope, for a musical tone, that is read from the storage means.

In consonance with the position of a half pedal, the second decay speed, during, for example, a period when a keyboard key is OFF and a pedal is ON, is controlled to change a tone generation state, or an acoustic state after tone generation, so that the same musical tone effects are produced as are obtained when using an acoustic musical instrument.

In the same manner, an attack speed, which is read in consonance with the distance a pedal is depressed, a tone generation level, or a timbre is changed so that various musical tones can be provided that can not usually be produced by conventional electronic musical instruments.

BRIEF DESCRIPTION OF THE DRAWINGS

FIG. 5 is a table of parameter memory for the embodiment of the present invention;

FIG. 6 is a table of envelope data memory for the embodiment of the present invention;

DETAILED DESCRIPTION OF THE PREFERRED EMBODIMENT

Figure 1:
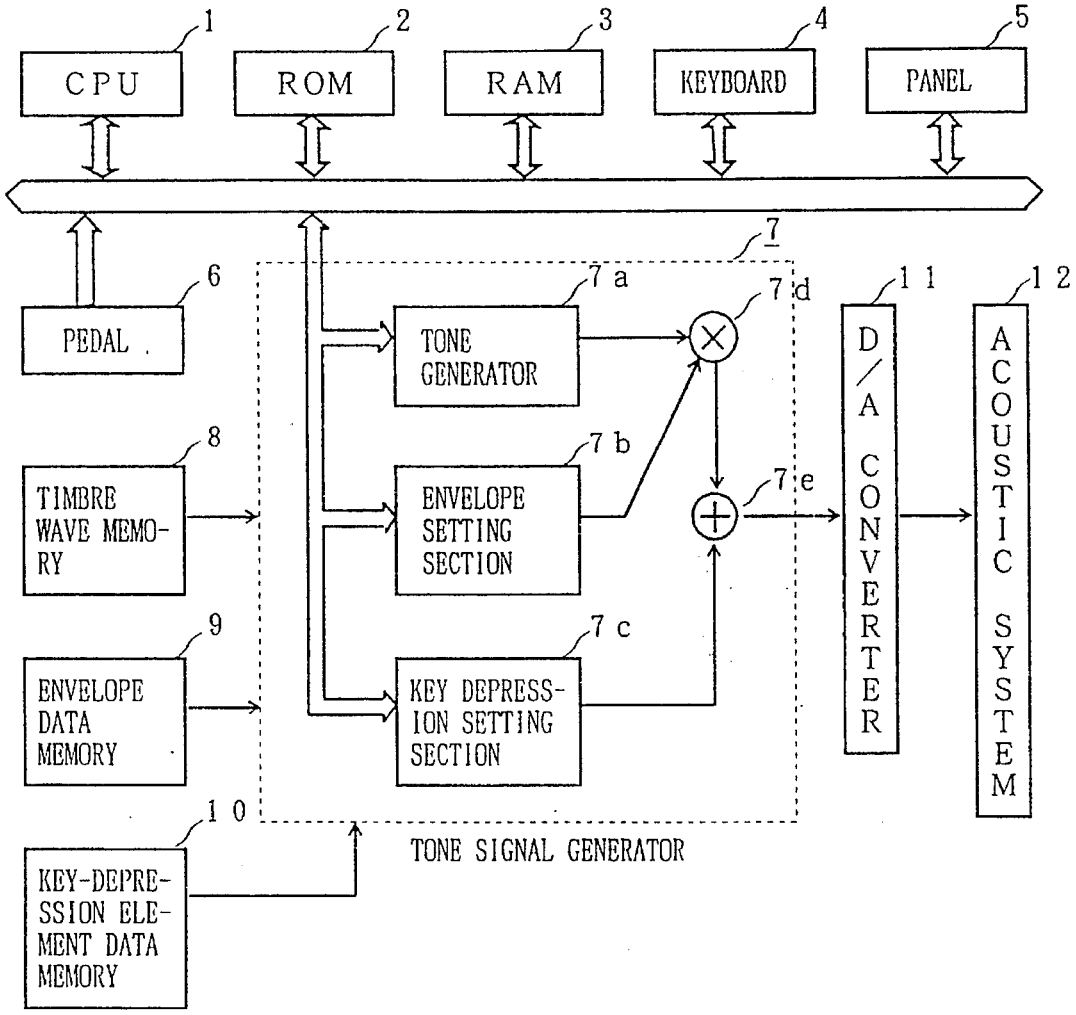
FIG. 1 is a diagram illustrating the general arrangement of one preferred embodiment of an electronic musical instrument according to the present invention.

FIG. 1 is a block diagram showing the general structure, according to the present invention, of the preferred embodiment of an electronic musical instrument that has a half pedal effect.

A CPU 1 employs a control program, which is stored in a program memory in a ROM 2, to control the individual sections of the electronic musical instrument. And in consonance with the position of a pedal, the CPU 1 reads a control parameter, from a control parameter table that is provided in the ROM 2, and sends the parameter that it has read to a tone signal generator 7.

Besides the program for actuating the CPU 1, in the ROM 2 are stored timbre data and other fixed data. A frequency number, a waveform number, an envelope waveform number, mode data, etc., all of which data are employed to generate a tone signal, are stored in a timbre data memory (not shown) in the ROM 2.

A timbre pointer is employed for the selection of each data item stored in the timbre data memory. More specifically, the timbre pointer is altered through panel operation, keyboard operation, or pedal operation and data selected by the altered timbre pointer is read from the timbre wave memory 8. Then, a given calculation is performed by employing the data that is read from the timbre wave memory 8 and the result is sent to the tone signal generator 7.

A table that is the main feature of the present invention, and that is employed to determine an attack speed, an attack level, a decay speed, a decay level, etc., is provided in the ROM 2.

In a RAM 3 are defined a work area for the CPU 1 and space for various registers, counters and flags that are employed for the control of the electronic musical instrument; a data area to which necessary data, which are stored in the ROM 2, are transmitted and stored; multiple registers where data are set to produce musical tones that correspond to the states of the keys and the switches on a panel 5; an assigner memory where data that are employed for the assignment of the tone generators in the tone signal generator 7 to unused channels are stored; and a storage area where play data are stored.

Data that reflect the setup states of the switches on the panel 5, which are stored in the RAM 3, are referred to by the CPU 1, etc. at the time of tone generation and at other times when needed. A key depression map, where are held key ON/OFF states for a keyboard 4, and a note-ON counter are also provided in the RAM 3.

The keyboard 4, which is used to select musical tones to be produced, consists of a plurality of keys and of key switches that open and close in consonance with key depression and key release. When key depression or key release by a player is detected, the CPU 1 controls the transmission of the detected signal to the tone signal generator 7.

Further, play data that are generated by the depression of a key or the release of a key at the keyboard are temporarily stored in the RAM 3, and are read by the CPU 1 as needed.

On the panel 5 are a variety of switches, including a power switch, a timbre select switch, a mode select switch, a melody select switch, a rhythm select switch, and an effect select switch for reverberation, chorus, etc.

The set/reset state of each switch is detected by an internal panel scan circuit. The data that are detected by the panel scan circuit of the panel 5 and that reflect the switch set state are stored in the RAM 3 under the control of the CPU 1.

In addition, a display device (not shown) for displaying various data is provided on the panel 5.

A pedal 6 can be, for example, a damper pedal, a soft pedal or a sostenute pedal, depending on the type of electronic musical instrument involved. In consonance with the position assumed by the pedal 6, the CPU 1 adjusts a variable resister to control voltages and to change volumes.

Since the electronic musical piano of this embodiment has a pedal position sensor 31 and an A/D converter 32 in its pedal section 6 (see FIG. 3), it can detect arbitrary intermediate positions of the pedal in addition to the absolute ON/OFF states of the pedal.

The tone signal generator 7 reads and reproduces tone wave data that are stored in the timbre wave memory 8, and generates and outputs tone signals that correspond to musical tones that are produced by various electronic musical instruments.

The tone signal generator 7 includes: a musical tone generating section 7*a*, which generates a musical tone in consonance with the contents stored in the timbre waveform memory 8; an envelope setting section 7*b*, which sets an envelope in consonance with the contents stored in the envelope data memory 9; a key depression element setting section 7*c*, which sets a depression element in consonance with the contents stored in a key-depression element data memory 10; a multiplier 7*d*, which multiplies an envelope by a waveform; and an adder 7*e*, which adds the product from the multiplier 7*d* to the waveform of the key-depression element that is set by the key depression element setting section 7*c*.

Then, control data that are input from the keyboard 4 and output by the CPU 1 are employed, and tone wave data that correspond to selected timbres and volumes are read from the timbre wave memory 8 and the envelope data memory 9. An envelope is added to the read tone wave data and the resultant data are transmitted as a tone signal to an A/D converter 11.

The timbre wave memory 8, which is, for example, a ROM, is used to store wave data for a musical tone, such as data for soft key depression and strong key depression. It should be noted that data for musical tones that are produced by a grand piano, which is neither electrically powered nor electronically controlled, are given an appropriate data form and are stored in the timbre wave memory 8.

A soft depression element tone signal generator or a strong depression element tone signal generator (neither shown) accesses the timbre wave memory 8.

The envelope data memory 9 is employed to store various data for envelopes that correspond to tone elements. From the envelope data memory 9, the content of a tone element select register (not shown) is employed as an address to select and output a given item of envelope data.

In this embodiment, envelopes for tone waves that are obtained from notes produced on a grand piano, which is neither electrically operated nor electronically controlled, are stored in the envelope data memory 9. The tone wave envelopes for OFF positions, for ON positions and for multiple intermediate positions are stored separately, even when they are for an identical depressed key.

The key-depression data memory 10 is used to store wave data for tone elements for which a frequency does not change in consonance with a pitch, i.e., wave data for a key depression element. Such stored data are the results obtained by extracting tone elements from tone waves that are produced for a depressed key on a grand piano, which is neither electrically operated nor electronically controlled.

A D/A converter 11 converts a digital tone signal, which is transmitted by the tone signal generator 7, into an analog signal. The analog signal that is obtained by the conversion that is performed by the D/A converter 11 is sent to an amplifier in an acoustic system 12.

Using volume data sent by the CPU 1, the acoustic system 12 amplifies the analog tone signal received from the D/A converter 11 by a predetermined gain and supplies the result to a loudspeaker. The loudspeaker changes the amplified analog tone signal into an acoustic signal and releases a musical tone.

Figure 2:
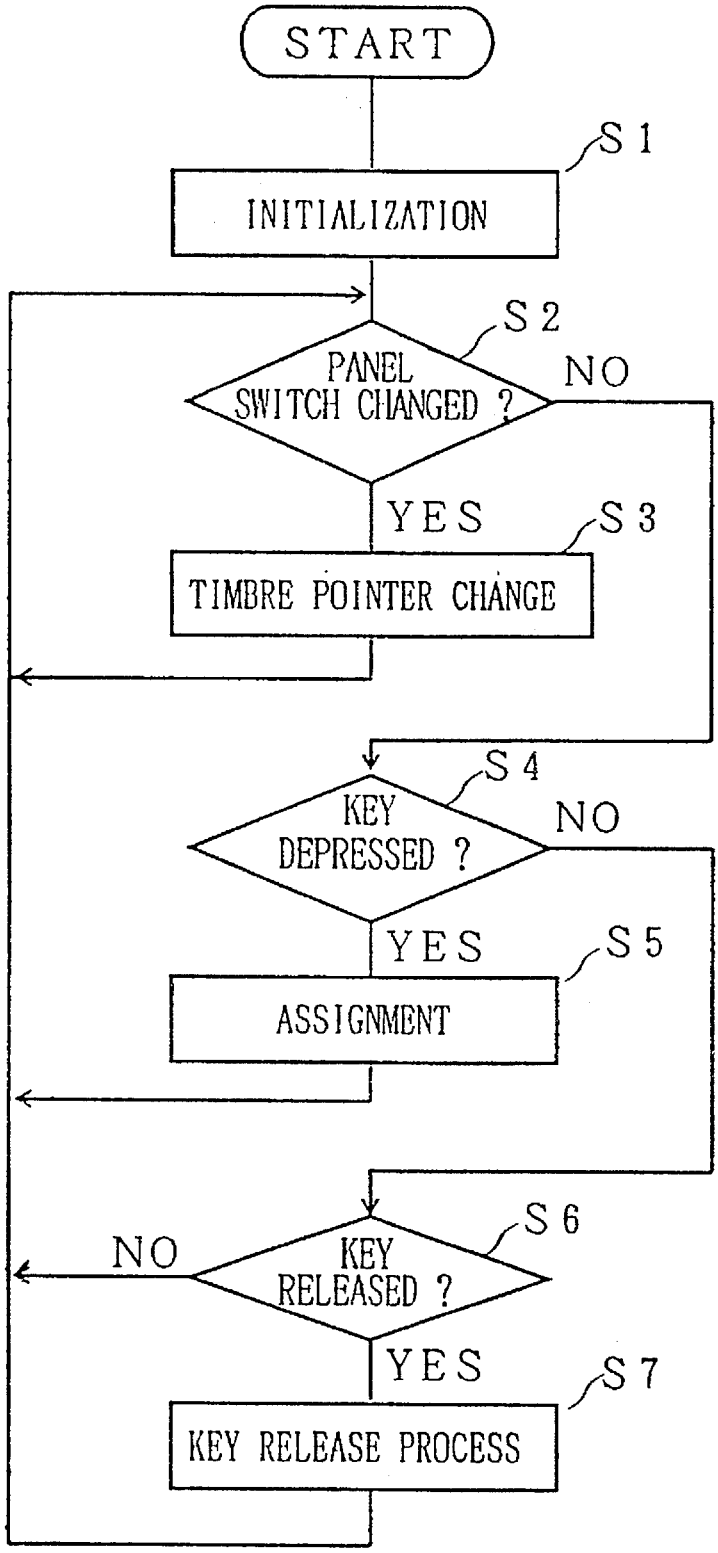
FIG. 2 is a flowchart showing the processing for the embodiment of the present invention.

FIG. 2 is a flowchart showing the processing of an electronic musical instrument according to the embodiment of the present invention. The processing of the electronic musical instrument of this embodiment will now be described while referring to FIG. 2.

When a power switch provided on the panel 5 is turned on, initialization is the first process performed (step S1).

During this process, the registers defined in the CPU 1 and in the RAM 3 are set to their initial states, specified data and a program stored in the ROM 2 are loaded to the RAM 3, a timbre pointer is initialized and an initial timbre is determined, etc.

A check is then performed to determine whether or not the setting of a timbre select switch on the panel 5 has been changed (step S2). When the setting of the panel switch has been changed, a timbre pointer is altered in consonance with the contents selected by the panel switch (step S3) and program execution returns to step S2.

When the panel switch setting has not been changed, a check is then performed to determine whether or not a key on the keyboard 4 has been depressed (step S4). When a key has been depressed, an assignment process for the depressed key is performed and program execution returns to step S2 (step S5).

In this assignment process, among the circuits, such as the tone generator 7*a*, that are provided in the tone signal generator 7 and that equal the number of polyphonic counts, the one that is to be employed for tone production is assigned to an unused channel.

A timbre set in the tone generator 7*a*, for example, that is assigned during the assignment process, a key touch that is detected by a touch sensor, a key number, etc. are transmitted to the CPU 1, which instructs the production of a tone signal that corresponds to the force of the key depression.

When a key has not been depressed, a check is performed to determine whether or not a key has been released (step S6). When no key has been released, program execution returns to step S2.

When a key has been released, a key release process is then performed (step S7). During this process, in consonance with the key number of the released key and the current pedal data, given envelope data are transmitted to the envelope setting section 7*b* that has already been actuated.

For example, with pedal-OFF data, predetermined release data are transmitted, an envelope is rapidly closed to "0," and tone production is halted.

The general processing for the electronic musical instrument of the present invention is performed by repeating the above described procedures.

Figure 3:
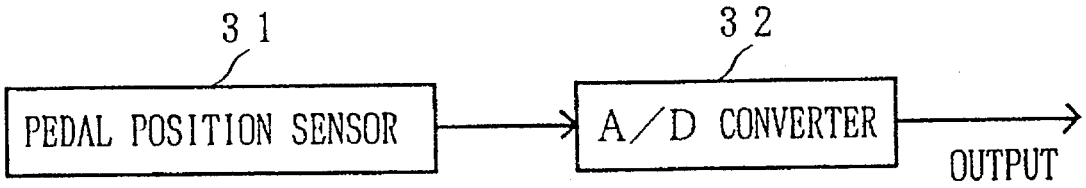
FIG. 3 is a diagram illustrating a pedal position sensing unit of the embodiment of the present invention.

FIG. 3 is a block diagram of the pedal section 6. Pedal data for a conventional electronic musical instrument consist of only two levels, either absolute ON or OFF, and as the data quantity is limited, delicate, expressive musical tones cannot be produced.

According to the present invention, the pedal position sensor 31 and the A/D converter 32 are provided in the pedal section, as shown in FIG. 3. The pedal position sensor 31 detects the position at which a pedal is located, i.e., an arbitrary intermediate value location situated between the absolute ON and OFF positions, and transmits the position detected as an analog signal to the A/D converter 32. The A/D converter 32 converts the analog signal into a digital signal and sends the resultant signal to the CPU 1.

In response to the signal, the CPU 1 controls the tone signal generator 7 to govern the production of musical tones during half pedal playing, i.e., when the pedal is located at an intermediate position between absolute ON and OFF.

The procedures employed to set up an envelope for the electronic musical instrument of the present invention will now be described.

Conventionally, the production of strong and soft musical tones is performed by adding envelopes to tone wave data that are read from a wave memory.

More specifically, an envelope signal is generated by designating a "target value level LV," which is a parameter for the designation of a target value (level) for a musical tone, and an "envelope speed parameter SP," which is a parameter for the designation of a time that will elapse before the musical tone attains the target value.

Then, the generated envelope signal is multiplied by tone wave data, which are read from a timbre wave memory 8, for the production of a musical tone with an added envelope.

An envelope is separated into, for example, three portions: an attack portion, a decay portion and a release portion. Stored with each portion in the envelope setting section 7*b* are the "target value level LV" and the "envelope speed parameter SP."

When the generation of an envelope signal is required, the parameters are employed to perform the computations. Envelope signals are generated by repeating the process, for example, during which a current value is held for an envelope to be generated, an envelope speed parameter SP is multiplied by the difference between the target value level LV and the current value, and the product is added to the current value.

Figure 4:
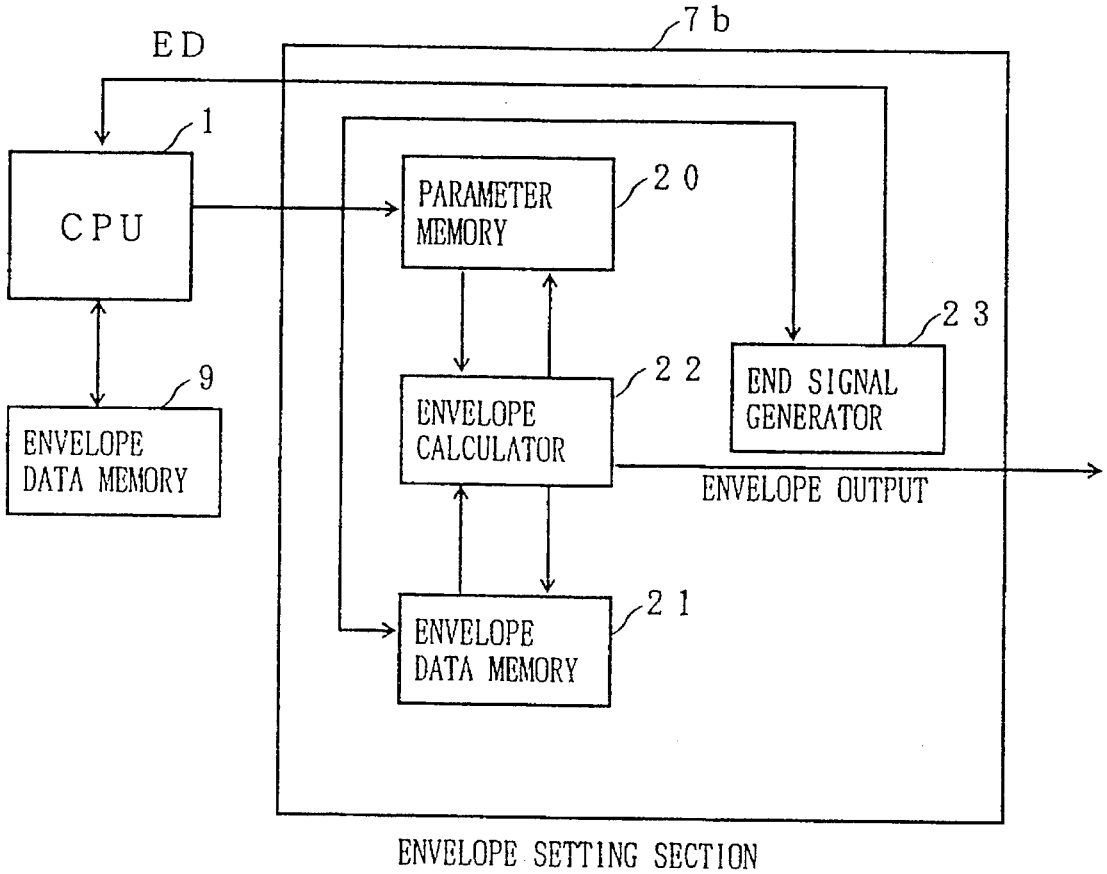
FIG. 4 is a diagram illustrating the arrangement of an envelope setting section of the electronic musical instrument according to the embodiment of the present invention.

Based on the above described principle, the structure and the processing of the envelope setting section 7*b* according to the present invention will now be described. FIG. 4 is a block diagram showing the structure of the envelope setting section 7*b*.

A parameter memory 20 is employed to store a "target value level LV" and an "envelope speed parameter SP" in the example form shown in FIG. 5.

An envelope data memory 21 is employed to store a current envelope value $\Sigma e$ (envelope accumulated value) in the format shown in FIG. 6.

An envelope calculator 22 first subtracts the current value $\Sigma e$, which is stored in the envelope data memory 21, from the target value level LV, which is stored in the work area (W) of the parameter memory 20.

The envelope calculator 22 then multiplies this remainder by the envelope speed parameter SP, which is stored in the work area (W) of the parameter memory 20. A calculation is then performed that employs this result and the current value $\Sigma e$, and the obtained value is output as an envelope and transmitted to the multiplier 7*d*.

When the current value $\Sigma e$ has reached the target value level LV, a signal that indicates that fact is transmitted to an end signal generator 23.

In response to the signal from the envelope calculator 22, the end signal generator 23 generates an end signal ED that is sent to the CPU 1.

With this arrangement, when key depression is detected, the CPU 1 accesses the timbre wave memory 8 while at the same time it reads a parameter (LV or SP), for a targeted channel, from the envelope data memory 9 and writes it into the parameter memory 20.

The parameter for the beginning portion of an envelope to be generated is written into the work area (W) of the parameter memory 20, and the parameter for the next portion is written into the buffer (B) (see FIG. 5).

In addition, the current value Σe of a channel area of the envelope data memory 21 is initialized; the end signal generator 23 is set to enable the generation of an end signal; and when the initial processing is completed, the envelope setting section **7*b*** is driven to begin the operation.

When key release is detected, the CPU 1 obtains pedal data, and in consonance with that data, updates the value in the parameter memory 20. More specifically, when the pedal state is OFF, the target value level LV is rewritten as "0" and the envelope speed parameter SP is rewritten to reflect a predetermined decay speed. When the pedal state is ON, the CPU 1 does not rewrite any data and maintains the decay state.

After the pedal-OFF state is detected, the parameter is rewritten to reflect a release value. When the pedal is located at an intermediate position between absolute ON and OFF, the parameter value that corresponds to that pedal position is read from the envelope data memory 9 and written into the parameter memory 20.

The parameter value is employed to obtain a rapidly attenuating envelope form for the pedal-ON state, or a slowly attenuating envelope form for the pedal-OFF state. After the pedal-OFF state is detected, the parameter is rewritten to reflect a release value and the production of musical tones is halted.

In this embodiment all the parameter values that correspond to pedal positions have been entered in a table in the envelope data memory 9. It may also be possible for the maximum and minimum values to be entered in a table and for the intermediate values to be calculated by using a mathematical function.

A change in an envelope during half pedal playing, which is the feature of the present invention, will now be explained while referring to the accompanying drawings.

FIG. 7 is a diagram showing a common envelope for a musical tone produced by an electronic musical instrument.

Figure 7A:
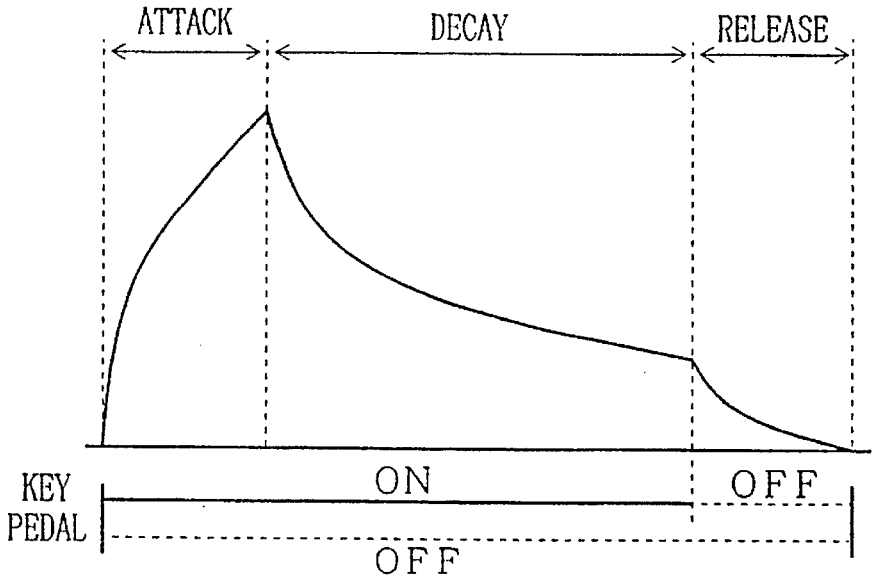
FIGS. 7A and 7B are graphs for explaining conventional envelope forms.

The envelope shown in FIG. 7A illustrates the one that is employed when there is no pedal depression. When the keyboard key is released, the state of the envelope changes to the release state at a predetermined speed.

Figure 7B:
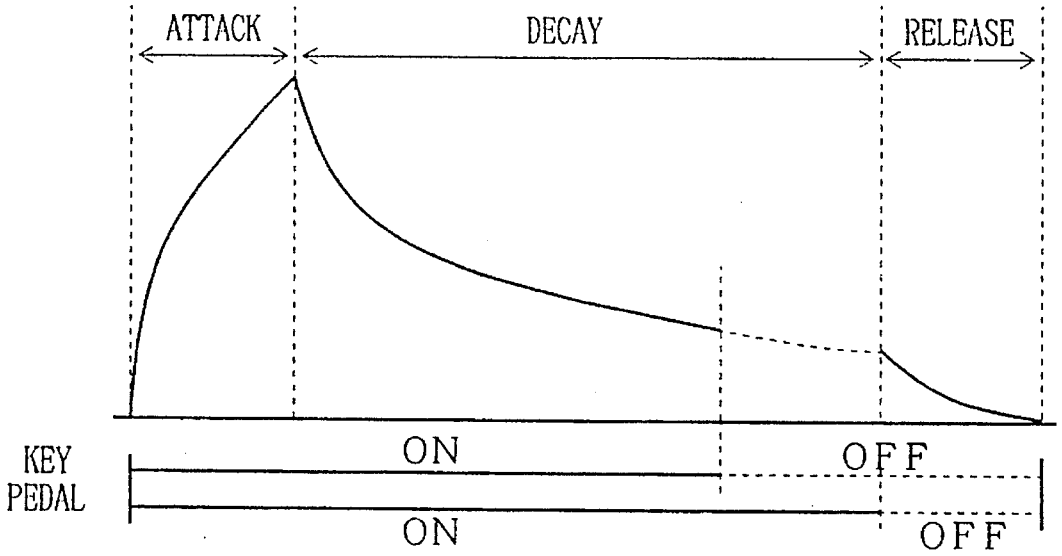

The envelope shown in FIG. 7B illustrates the one that is employed when there is pedal depression. Even if the keyboard key is released, while the pedal is in the ON state the decay state of the envelope continues. Then, when the state of the pedal is changed to OFF, the state of the envelope changes to the release state.

The release speed at this time is the same as that depicted in FIG. 7A.

According to a conventional electronic musical instrument, a timbre and an envelope shape are changed by detecting the ON/OFF state of a pedal, so that the shape of an envelope has only the two patterns shown in FIGS. 7A and 7B.

Figure 8A:
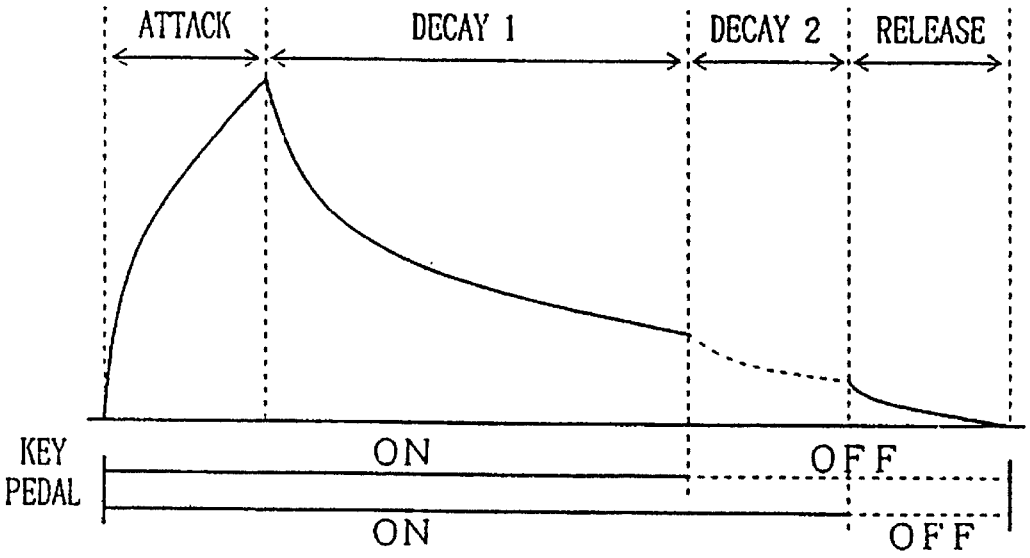
FIGS. 8A and 8B are graphs for explaining envelope forms for half pedal playing with the embodiment of the present invention.

FIG. 8A is a diagram for explaining the shape of an envelope and an envelope speed for the half pedal state, which is the feature of the present invention.

Figure 8B:
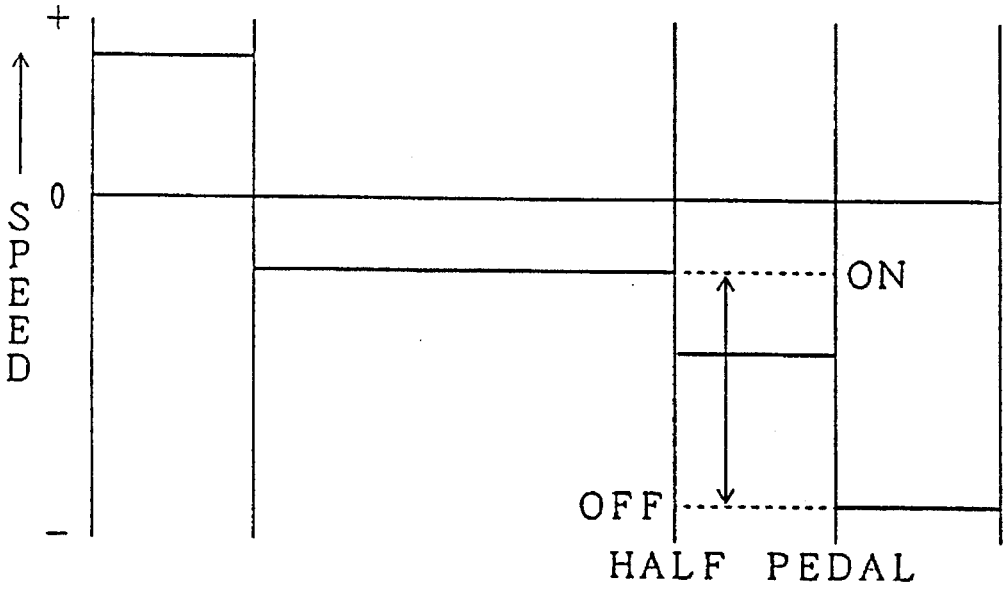

When a pedal is positioned for the half-pedal state (see FIG. 8B), an envelope moves to the decay state at a speed that is set in advance for a pedal position. When the pedal is absolutely OFF, the speed returns to a normal release speed.

More specifically, a decay speed, which is effective when the pedal is located at an intermediate position and a keyboard key is OFF, is changed in accordance with a pedal position, which is detected during the change from the decay speed for the pedal-ON state to the decay speed for the pedal-OFF state.

Through the above described processing, half pedal playing is enabled for an electronic musical instrument that can vary the modulation of sounds in correspondence with the positioning of a pedal.

As one method by which to provide the half pedal effect for an electronic musical instrument, the instrument may be so designed that, at step S4 in FIG. 2, the CPU 1 can obtain pedal data upon key depression; that, in accordance with a pedal position, a different wave can be selected from the timbre wave memory 8 even though an identical key is depressed; and that timbre codes for selecting a timbre that corresponds to a pedal position are stored in advance in the ROM 2.

In addition, an electronic musical instrument may be so designed that the tone generator **7*a* generates an address for the timbre wave memory 8, where wave data that correspond to a timbre code in consonance with a pedal position are stored; transmits the address to the tone wave memory 8**, at a speed that corresponds to a frequency number; and reads a corresponding waveform, so that a different timbre can be acquired, depending on the position of a pedal.

As another method, an electronic musical instrument may be so designed that the CPU 1 acquires pedal position data upon key depression, at step S4 in FIG. 2, and parameters (LV and SP) are stored in the envelope data memory 9 to provide an envelope shape that differs from the one for the pedal-OFF state.

Thus, as not only the decay and release portions of the envelope for a musical tone but also the attack portion of the envelope can correspond to a pedal position, a player can exercise better control over the production of musical tones than is possible with the conventional way of playing, which involves only the detection of the ON/OFF state of a pedal.

Although in this embodiment the method that has mainly been explained for providing half pedal effects has been one that involves the changing of the decay portion of an envelope, other methods for performing half pedal effects may be employed, depending on the positioning of a pedal, such as:

(1) changing the attack speed;

(2) changing a level for tone generation; and (3) changing a timbre to be called for.

Combinations of these methods can also be employed.

Any of the above described methods can be employed for the present invention. By employing these methods, it is possible to produce a greater variety of modulated sounds.

As described above in detail, according to an electronic musical instrument of the present invention, the decay portion of an envelope is changed, in consonance with the position of a depressed pedal, to provide the same effects as those provided by an acoustic piano.

Further, an attack speed, a tone generation level, a timbre, etc. are altered, in consonance with the position of a depressed pedal, to provide a variety of modulated sound effects that differ from those that are produced by a conventional electronic musical instrument.

Although the preferred embodiment of the present invention and the claims particularly point out the subject matter regarded as the invention, various other modifications are contemplated as being within the scope of the invention.

What is claimed is:

1. In an electronic musical instrument having keys which are operated to generate musical notes from tone generating means, each of the musical notes having a tone envelope with an attack portion initiated by operating a key to an ON condition, a subsequent first decay portion in which the key remains in the ON condition, and a release portion initiated by releasing the key to an OFF condition, said instrument having an operator operable through a plurality of incremental positions in an operating range extending between an OFF position and an ON position, the invention comprising circuitry for altering the musical properties of the generated notes of the musical instrument in accordance with the incremental position of the operator in its operating position range, said circuitry comprising:

storage means for storing tone data comprising musical property alterations for a second decay portion of the tone envelope of a note, the second decay portion occurring subsequent to said first decay portion and comprising the period between the time the key producing the note is released to the OFF condition and the time the operator is thereafter placed in the OFF position, the characteristics of the musical property alterations in the second decay portion varying as the incremental position of the operator in the operating range varies;

first detecting means for detecting whether a tone generating key is in the ON condition or the OFF condition;

second detecting means for detecting whether the operator is in the ON position or the OFF position and for detecting the incremental position of the operator in its operating range;

circuit means for determining the occurrence of conditions creating a second decay period in a tone envelope for a note; and reading means for selecting and reading out the musical property altering tone data from said storage means in accordance with the incremental position of the operator during the second decay portion and for supplying the tone data to the tone generating means for generating a musical note having altered musical properties.

2. The circuitry according to claim 1 wherein said storage means is further defined as storing tone data comprising note decay characteristics for the second decay portion of the tone envelope.

3. The circuitry according to claim 1 wherein said storage means is further defined as storing data comprising attack speed data for the attack portion of the tone envelope, the characteristics of the attack speed data varying as the incremental position of the operator in the operating range varies, and wherein said reading means is further defined as selecting and reading out attack speed data from said storage means in accordance with the incremental position of the operator and for supplying the attack speed data to the tone generating means.

4. The circuitry according to claim 1 wherein said storage means is further defined as storing data comprising tone generation level data for the tone envelope, the characteristics of the tone generation level data varying as the incremental position of the operator in the operating range varies, and wherein said reading means is further defined as selecting and reading out tone generation level data from the storage means in accordance with the incremental position of the operator and for supplying the tone generation level data to the tone generating means.

5. The circuitry according to claim 1 wherein said storage means is further defined as storing data comprising timbre data for the note, the characteristics of the timbre data varying as the incremental position of the operator in the operating range varies, and wherein said reading means is further defined as selecting and reading out timbre data from said storage means in accordance with the incremental position of the operator and for supplying the timbre data to the tone generating means.

6. The circuitry according to claim 1 wherein said storage means comprises envelope data memory means for storing tone envelope data.

7. The circuitry according to claim 1 further defined as including said tone generating means, said tone generating means generating a tone envelope and comprising means establishing target values for the tone envelope and means establishing an envelope speed parameter designating the period of time required for said tone generating means to cause the value of the musical tone to reach the target value.

8. The circuitry according to claim 7 wherein said means establishing tone envelope target values and said means establishing envelope speed parameters are further defined as establishing tone envelope target values and speed parameters for each of the attack portion, first decay portion, and release portion of a tone envelope.

* * * * *